US009854378B2

(12) United States Patent
Sun et al.

(10) Patent No.: US 9,854,378 B2
(45) Date of Patent: Dec. 26, 2017

(54) AUDIO SPATIAL RENDERING APPARATUS AND METHOD

(71) Applicant: DOLBY LABORATORIES LICENSING CORPORATION, San Francisco, CA (US)

(72) Inventors: Xuejing Sun, Beijing (CN); Gary Spittle, Hillsborough, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 14/768,676

(22) PCT Filed: Jan. 30, 2014

(86) PCT No.: PCT/US2014/013778
§ 371 (c)(1),
(2) Date: Aug. 18, 2015

(87) PCT Pub. No.: WO2014/130221
PCT Pub. Date: Aug. 28, 2014

(65) Prior Publication Data

US 2015/0382127 A1 Dec. 31, 2015

Related U.S. Application Data

(60) Provisional application No. 61/774,481, filed on Mar. 7, 2013.

(30) Foreign Application Priority Data

Feb. 22, 2013 (CN) ..... 2013 1 0056655

(51) Int. Cl.
*H04S 7/00* (2006.01)

(52) U.S. Cl.
CPC ..... *H04S 7/30* (2013.01); *H04S 2400/11* (2013.01); *H04S 2420/01* (2013.01)

(58) Field of Classification Search
CPC .... H04S 7/30; H04S 2420/01; H04S 2400/11; H04M 3/568
See application file for complete search history.

(56) References Cited

U.S. PATENT DOCUMENTS 6,011,851 A 1/2000 Connor
6,307,941 B1 10/2001 Tanner, Jr.
(Continued)

FOREIGN PATENT DOCUMENTS

CN 102903368 1/2013
EP 1269306 1/2003
(Continued)

OTHER PUBLICATIONS

Brutti et al., Comparison betweeen Different Sound Source Localization Techniques Based on a Real Data Collection, IEEE, 2008, p. 1 and 2.*

(Continued)

*Primary Examiner* — Sonia Gay

(57) ABSTRACT

An audio spatial rendering apparatus and method are disclosed. In one embodiment, The audio spatial rendering apparatus includes a rendering unit for spatially rendering an audio stream so that the reproduced far-end sound is perceived by a listener as originating from at least one virtual spatial position, a real position obtaining unit for obtaining a real spatial position of a real sound source, a comparator for comparing the real spatial position with the at least one virtual spatial position; and an adjusting unit for, where the real spatial position is within a predetermined range around at least one virtual spatial position, or vice versa, adjusting
(Continued)

the parameters of the rendering unit so that the at least one virtual spatial position is changed.

14 Claims, 14 Drawing Sheets

(56) References Cited

U.S. PATENT DOCUMENTS

| | | | | |
|---|---|---|---|---|
| 6,449,593 | B1 * | 9/2002 | Valve | G01V 1/001 704/233 |
| 7,181,027 | B1 * | 2/2007 | Shaffer | H04M 9/082 375/346 |
| 7,391,877 | B1 | 6/2008 | Brungart | |
| 7,464,029 | B2 | 12/2008 | Visser | |
| 7,561,699 | B2 | 7/2009 | Jot | |
| 7,577,260 | B1 | 8/2009 | Hooley | |
| 7,634,073 | B2 | 12/2009 | Kanada | |
| 8,144,886 | B2 | 3/2012 | Ishibashi | |
| 8,175,291 | B2 | 5/2012 | Chan | |
| 8,190,438 | B1 * | 5/2012 | Nelissen | G10L 21/00 381/85 |
| 8,223,992 | B2 | 7/2012 | Suzuki | |
| 8,238,563 | B2 | 8/2012 | Rumsey | |
| 8,275,148 | B2 | 9/2012 | Li | |
| 9,084,070 | B2 | 7/2015 | Crockett | |
| 2006/0072764 | A1 * | 4/2006 | Mertens | H04S 1/00 381/56 |
| 2007/0154001 | A1 | 7/2007 | Rambo | |
| 2008/0205659 | A1 | 8/2008 | Fischer | |
| 2008/0260131 | A1 | 10/2008 | Akesson | |
| 2010/0074433 | A1 | 3/2010 | Zhang | |
| 2010/0135510 | A1 * | 6/2010 | Yoo | G10L 19/008 381/300 |
| 2010/0262419 | A1 * | 10/2010 | De Bruijn | G10L 15/1822 704/9 |
| 2011/0051940 | A1 | 3/2011 | Ishikawa | |
| 2011/0096915 | A1 | 4/2011 | Nemer | |
| 2012/0014527 | A1 | 1/2012 | Furse | |
| 2012/0051547 | A1 | 3/2012 | Disch | |
| 2012/0101610 | A1 | 4/2012 | Ojala | |
| 2012/0114130 | A1 * | 5/2012 | Lovitt | G10L 21/028 381/73.1 |
| 2012/0257761 | A1 | 10/2012 | Kumar | |
| 2012/0328137 | A1 * | 12/2012 | Miyazawa | H04S 7/304 381/309 |
| 2013/0041648 | A1 | 2/2013 | Osman | |
| 2013/0218560 | A1 * | 8/2013 | Hsiao | G10L 21/0205 704/233 |
| 2014/0226842 | A1 * | 8/2014 | Shenoy | H04N 7/147 381/303 |
| 2015/0098571 | A1 * | 4/2015 | Jarvinen | H04S 7/301 381/1 |

FOREIGN PATENT DOCUMENTS

| | | |
|---|---|---|
| WO | 01/35118 | 5/2001 |
| WO | 2011/135283 | 11/2011 |
| WO | 2012/025580 | 3/2012 |
| WO | 2012/072798 | 6/2012 |

OTHER PUBLICATIONS

Kallinger, M. et al "Spatial Filtering Using Directional Audio Coding Parameters" IEEE International Conference on Acoustics, Speech and Signal Processing, Apr. 19-24, 2009, pp. 217-220.

Kyriakakis, C. et al "Surrounded by Sound" IEEE Signal Processing Magazine, vol. 16, Issue 1, Jan. 1999, pp. 55-66.

Kocinski, J. et al "Speech Intelligibility in Various Spatial Configurations of Background Noise" Archives of Acoustics, Jan. 27, 2005, pp. 173-191.

Rayleigh, L. "On our Perception of Sound Direction" Philosophical Magazine Series 6, vol. 13, No. 74, pp. 214-232, 1907; published online Apr. 16, 2009.

Fornari, J. et al "Interactive Spatialization and Sound Design Using an Evolutionary System" Proc. of the 2007 Conference on New Interfaces for Musical Expression, New York, NY, USA, pp. 293-298.

Blauert, Jens "Spatial Hearing" The MIT Press, Cambridge, 1983.

Duan, J. et al "Sound Source Location Based on BP Neural Network and TDOA" Telecommunication Engineering, vol. 47, No. 5, Oct. 2007.

Xia, Y. et al "A Rectangular Microphone Array Based Improved GCC-PHAT Voice Localization Algorithm" Shandong Science, vol. 24, No. 6, Dec. 2011.

Wang, J. et al "Codec-Independent Sound Activity Detection Based on the Entropy with Adaptive Noise Update", 9th International Conference on Software Process, Oct. 26-29, 2008.

* cited by examiner

AUDIO SPATIAL RENDERING APPARATUS AND METHOD

CROSS-REFERENCE TO RELATED APPLICATIONS

This application claims priority to Chinese Patent Application No. 201310056655.6, filed on 22 Feb. 2013 and U.S. Provisional Patent Application No. 61/774,481, filed on 7 Mar. 2013, each of which is hereby incorporated by reference in its entirety.

TECHNICAL FIELD

The present application relates generally to audio signal processing. More specifically, embodiments of the present application relate to an apparatus and a method for spatially rendering an audio signal.

BACKGROUND

In an audio reproducing system, the incoming audio streams are often rendered spatially to improve intelligibility and the overall experience. For example, a reproduced music may be spatially rendered so that the listener may have almost the same experience as in a music hall, with various instruments perceived as being placed at their proper positions with respect to the listener as if the band is just before the listener. As another example, in an audio conferencing system, the voices of multiple talkers at the far end may be spatially rendered at the near end as if they are sitting before the near-end listener and also spaced apart from each other so that the listener may readily distinguish different talkers.

SUMMARY

The present application proposes a novel way of spatial rendering that adapts the rendering to the local environment.

According to an embodiment of the application, an audio spatial rendering apparatus includes: a rendering unit for spatially rendering an audio stream so that the reproduced far-end sound is perceived by a listener as originating from at least one virtual spatial position, a real position obtaining unit for obtaining a real spatial position of a real sound source, a comparator for comparing the real spatial position with the at least one virtual spatial position; and an adjusting unit for, where the real spatial position is within a predetermined range around at least one virtual spatial position, or vice versa, adjusting the parameters of the rendering unit so that the at least one virtual spatial position is changed.

According to another embodiment, an audio spatial rendering method includes: obtaining at least one virtual spatial position from which a reproduced far-end sound to be spatially rendered from an audio stream is perceived by a listener as originating; obtaining a real spatial position of a real sound source; comparing the real spatial position with the at least one virtual spatial position; adjusting, where the real spatial position is within a predetermined range around the at least one virtual spatial position or vice versa, parameters for spatial rendering so that the at least one virtual spatial position is changed; and spatially rendering the audio stream based on the parameters as adjusted.

Also disclose is a computer-readable medium having computer program instructions recorded thereon, when being executed by a processor, the instructions enabling the processor to execute an audio spatial rendering method includes: obtaining at least one virtual spatial position from which a reproduced far-end sound to be spatially rendered from an audio stream is perceived by a listener as originating; obtaining a real spatial position of a real sound source; comparing the real spatial position with the at least one virtual spatial position; adjusting, where the real spatial position is within a predetermined range around the at least one virtual spatial position, parameters for spatial rendering so that the at least one virtual spatial position is changed; and spatially rendering the audio stream based on the parameters as adjusted.

According to the embodiments of the present application, an audio signal may be spatially rendered with the local environment taken into account at least partly so that the reproduced sound will not be interfered by local interfering sound such as noise (background sound) and/or other useful sounds on site.

BRIEF DESCRIPTION OF DRAWINGS

The present application is illustrated by way of example, and not by way of limitation, in the figures of the accompanying drawings, in which like reference numerals refer to similar elements and in which.

DETAILED DESCRIPTION

Figure 1:
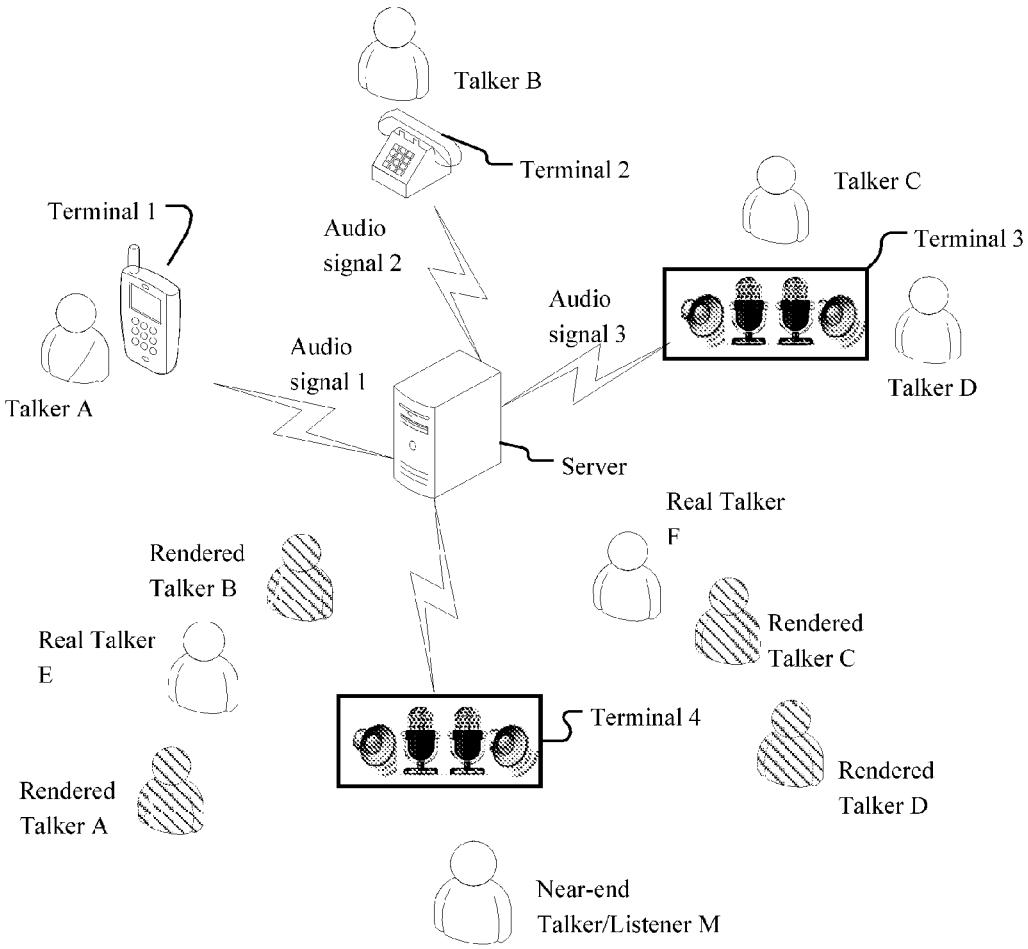
FIG. 1 is a diagram schematically illustrating an exemplary voice communication system where embodiments of the application can be applied.

The embodiments of the present application are below described by referring to the drawings. It is to be noted that, for purpose of clarity, representations and descriptions about those components and processes known by those skilled in the art but not necessary to understand the present application are omitted in the drawings and the description.

As will be appreciated by one skilled in the art, aspects of the present application may be embodied as a system, a device (e.g., a cellular telephone, a portable media player, a personal computer, a server, a television set-top box, or a digital video recorder, or any other media player), a method or a computer program product. Accordingly, aspects of the present application may take the form of an hardware embodiment, an software embodiment (including firmware, resident software, microcodes, etc.) or an embodiment combining both software and hardware aspects that may all generally be referred to herein as a "circuit," "module" or "system." Furthermore, aspects of the present application may take the form of a computer program product embodied in one or more computer readable mediums having computer readable program code embodied thereon.

Any combination of one or more computer readable mediums may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic or optical signal, or any suitable combination thereof.

A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wired line, optical fiber cable, RF, etc., or any suitable combination of the foregoing.

Computer program code for carrying out operations for aspects of the present application may be written in any combination of one or more programming languages, including an object oriented programming language such as Java, Smalltalk, C++ or the like and conventional procedural programming languages, such as the "C" programming language or similar programming languages. The program code may execute entirely on the user's computer as a stand-alone software package, or partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present application are described below with reference to flowchart illustrations and/or block diagrams of methods, apparatus (systems) and computer program products according to embodiments of the application. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational operations to be performed on the computer, other programmable apparatus or other devices to produce a computer implemented process such that the instructions which execute on the computer or other programmable apparatus provide processes for implementing the functions/acts specified in the flowchart and/or block diagram block or blocks.

System Overview

FIG. 1 is a diagram schematically illustrating an example voice communication system where embodiments of the application can be applied.

As illustrated in FIG. 1, in a first scenario without considering talkers C and D, two far-end talkers A and B may use monaural terminals 1 and 2 to participate in a conference call with a near-end talker, who is also a listener of the far-end voices of talkers A and B. The voices of talkers A and B are carried in respective audio signals 1 and 2 and transmitted via communication links to a conferencing call server, which forwards the audio signals via communication links to the near-end talker/listener M's terminal 4 and reproduced thereby. For improving intelligibility of the voices of the far-end talkers A and B, terminal 4 may spatially render the audio signal 1 and 2 so that far-end talkers A and B may sound like positioned at two different positions ("rendered talker A" and "rendered talker B" in FIG. 1) in the meeting room where the near-end talker/listener M is located. When the talkers 1 and 2 speak at the same time, the server may mix the audio signals 1 and 2 or combine the packets of the audio signals into one bigger packet and forward to the near-end talker/listener M's terminal 4, depending on bandwidth or other factors. When there are multiple talkers and thus multiple audio signals, the server may mix or combine some of them. For example, we may merge four audio streams into three audio streams. Mixing or combining can be performed on the server or the client depending on server and client's scalability or other factors. Similarly, spatial rendering may be done before the mixing or combining.

In a second scenario (without considering talkers A and B) still illustrated in FIG. 1, another two far-end talkers C and D may use a terminal 3, which is a spatial capturing and rendering end point, to have a conference call with the near-end talker/listener M, whose terminal 4 may also be a spatial capturing and rendering end point. Note that in FIG. 1 terminals 3 and 4 are shown as stereo terminals with 2 microphones and 2 loudspeakers, but this is definitely not limiting and they should be construed as including any spatial capturing (and rendering) end point. The audio signal 3, which is a sound field signal, of talkers C and D is transmitted via communication links and the server to the near-end talker/listener M's terminal 4. Terminal 4 may reproduce audio signal 3 as it is or with some additional processing, so that far-end talkers C and D may sound like positioned at two different positions ("rendered talker C" and "rendered talker D" in FIG. 1) in the meeting room where the near-end talker/listener M is located, and the positions of rendered talkers C and D correspond to their real positions at the side of terminal 3.

Of course, the two scenarios discussed above may be mixed as a third scenario, wherein monaural talkers A and B together with talkers C and D using the spatial capturing and rendering end point participate in a conference call with the near-end talker/listener M, the monaural voices carried in audio signals 1 and 2 and the stereo/spatially captured voice carried in audio signal 3 are transmitted via communication links to the server, mixed or not mixed, and then are spatially rendered by terminal 4 so that far-end talkers A-D may sound like positioned at four different positions ("rendered talker A to D" in FIG. 1) in the meeting room where the near-end talker/listener M is located, and the positions of rendered talkers C and D correspond to their real positions at the side of terminal 3.

In all the three scenarios, there may be other conference participants and/or persons irrelevant to the conference in the same meeting room where the near-end talker/listener M is located, such as real talkers E and F as shown in FIG. 1. In addition, in the description above, the near-end talker/listener M is regarded as "the center". Of course we can envisage that every participants in the conference call has an equal status and for every talker, the situation may be similar to the near-end talker/listener M. In addition, there may be other interfering sound sources such as air conditioners and so on.

Please note that the voice communication system as illustrated in FIG. 1 is just an example and not intended to limit the scope of the invention, and other applicant scenarios may be envisaged, such as an audio reproducing system for spatially rendering music played by a band, so that various instruments will be rendered at different virtual positions. The various instruments in such a scenario are equivalent to the different talkers A to D in the scenario(s) shown in FIG. 1, the difference lies in that generally the music has been recorded in a medium or is transmitted/broadcasted as a single audio stream.

Adjustment of Rendered Virtual Position

In a first embodiment of the present application, it is proposed to adjust the virtual positions of the rendered talkers for improving speech intelligibility of, for example, at least some of the rendered talkers in the scenarios as shown in FIG. 1, so that they will not overlap with or be too close to each other, thus their voices will not interfere each other.

Figure 2:
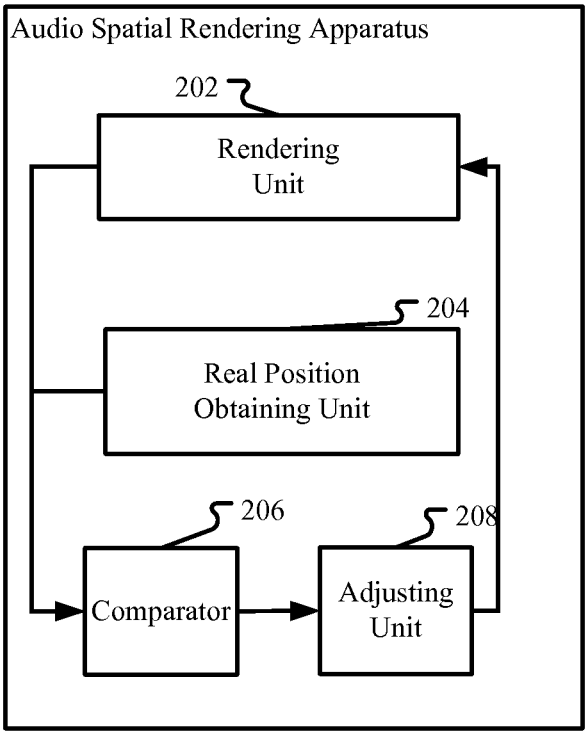
FIG. 2 is a diagram illustrating an audio spatial rendering apparatus according to an embodiment of the application.

Specifically, as shown in FIG. 2, an audio spatial rendering apparatus is provided, comprising a rendering unit 202, a real position obtaining unit 204, a comparator 206 and an adjusting unit 208.

The rendering unit 202 is configured to spatially render an audio stream so that the reproduced far-end sound is perceived by a listener as originating from at least one virtual spatial position. There are many existing techniques for spatial audio rendering. If the original audio signal is a stereo/spatially captured or sound field signal, such as audio signal 3 in the second scenario FIG. 1, then the rendering unit may just reproduce the received stereo/sound field signal (such as audio signal 3) with spatial rendering techniques and the spatial positions of the talkers (such C and D) with respect to the original terminal (such as terminal 3 in the original meeting room where the real talkers C and D are located) are just "copied" as the virtual spatial positions of the rendered talkers with respect to the near-end talker/listener. Depending on situations, some additional processing is possible, rather than simply copying.

If the original audio signal is a monaural signal, such as audio signals 1 and 2 in the first scenario in FIG. 1, then different audio signals may be assigned different spatial auditory properties, so that they may be perceived as originating from different positions (rendered talkers A and B) relative to the near-end listener. This work can be done at the side of the talkers, or the server, or the listeners. If the original audio signals have been spatialized at the side of the talkers or the server, what the listener's terminal (terminal 4) receives will be a spatialized audio signal, and what the listener's terminal need do is, also, just to reproduce the spatialized audio signal as if it were originally produced as a spatialized/stereo/sound field signal. There are many existing spatialization techniques for assigning different spatial auditory properties to different audio signals, which will be briefly introduced below.

As mentioned in the "System Overview" part, the audio signals 1 and 1 from the talkers, whether or not spatialized, may be mixed or combined at the side of the talkers or the server. If the audio signals have been mixed/combined at the side of the talkers/server without spatialization, the listener's terminal need distinguish the voices/speeches from different talkers, and this may be done with many existing single channel source separation techniques and may be regarded as a part of the spatialization or spatial rendering.

In the third scenario in FIG. 1, where there are both monaural audio signal 1 and 2 using monaural terminals 1 and 2 and audio signal 3 using stereo terminal 3, there is a hybrid process with the first and second scenarios as mentioned above integrated together. Again, if the original monaural audio signals have been spatialized at the side of the talkers or the server, what the listener's terminal need do is just to reproduce the received audio signal including the component of the spatialized audio signal as well as the component of the original stereo/sound field signal. If the original monaural audio signals have not been spatialized at the side of the talkers or the server but have been mixed/combined, then the listener's terminal need reproduce the original stereo/sound field signal and at the same time separate the different monaural audio signals and spatially render them. Certainly, depending on situations, additional processing may be possible even for the original sound field signal, just like the present application will do.

Now turn to existing spatialization or spatial rendering techniques. In the present disclosure, the term "spatialization" and the term "spatial rendering" have substantially the same meaning, that is, assigning specific spatial auditory properties to an audio signal so that the audio signal may be perceived as originating from a specific spatial position relative to the near-end listener. But depending on the context, "spatial rendering" contains more meaning of "reproducing" the audio signal using the assigned or original spatial auditory properties. For conciseness, the two terms will not necessarily be mentioned at the same time in the description below unless otherwise necessary.

Generally speaking, spatial rendering may be based on at least one of head-related transfer function (HRTF), inter-aural time difference (ITD) and inter-aural intensity difference (IID), also known as the inter-aural level difference (ILD).

ITD is defined as the difference in arrival times of a sound's wavefront at the left and right ears. Similarly, IID is defined as the amplitude difference generated between the right and left ears by a sound in the free field.

Figure 3A:
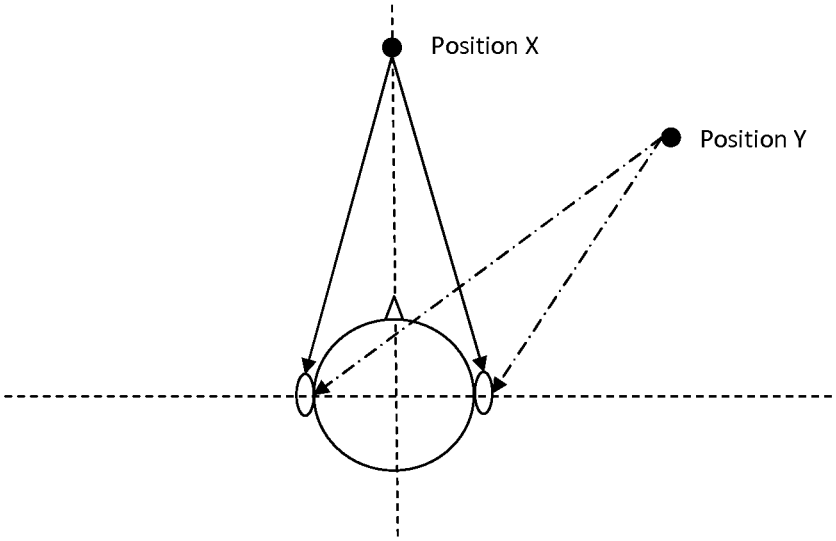
FIGS. 3A to 3C are diagrams illustrating examples of principles for spatial rendering.

It has been shown that both ITD and IID are important parameters for the perception of a sound's location in the azimuthal plane, e.g., perception of the sound in the "left-right" direction. In general, a sound is perceived to be closer to the ear at which the first wavefront arrives, where a larger ITD translates to a larger lateral displacement. For example, in FIG. 3A, position X in the median plane corresponds to an ITD of zero; and for position Y, since the first wavefront arrives at the right ear, the sound source will be perceived as being displaced rightwards with respect to the median plane. In other words, for pure sinusoids, perceived lateral displacement is proportional to the phase difference of the received sound at the two ears. However, at approximately 1500 Hz, the wavelength of a sinusoid becomes comparable to the diameter of the head, and ITD cues for azimuth become ambiguous. At these frequencies and above, ITD's may correspond to distances that are longer than one wavelength. Thus, an aliasing problem occurs above 1500 Hz, and the difference in phase no longer corresponds to a unique spatial location.

At frequencies above 1500 Hz, the head starts to shadow the ear farther away from the sound, so that less energy arrives at the shadowed ear than at the non-shadowed ear. The difference in amplitudes at the ears is the HD, and has been shown to be perceptually important to azimuth decoding at frequencies above 1500 Hz. The perceived location does not vary linearly with IID alone, as there is a strong dependence on frequency in this case. However, for a given frequency, the perceived azimuth does vary approximately linearly with the logarithm of the IID.

Therefore, for spatially rendering an audio signal to different virtual positions, the rendering unit 202 may be configured to adapt the audio signal so that the reproduced sound will present corresponding ITDs and/or IIDs.

For more details about spatial rendering/spatialization using ITD and/or HD, reference may be made to Rayleigh, L. "*On our perception of sound direction*" Philosophical Magazine 13: 1907; Blauert, Jens. *Spatial Hearing*. The MIT Press, Cambridge: 1983; and Jose Fornari et al. "*Interactive Spatialization and Sound Design using an Evolutionary System*", Proceedings of the 2007 Conference on New Interfaces for Musical Expression (NIME07), New York, N.Y., USA. All the three documents are incorporated herein in their entirety by reference.

Psychoacoustic research has revealed that besides the relationship between ITD, IID and perceived spatial location, additional cues exist, which may be captured by the Head-Related Transfer Function (HRTF). HRTF is defined as a Fourier transform of the sound pressure impulse response (known as HRIR, Head-Related Impulse Response) at a point of the ear channel of a listener, normalized with respect to the sound pressure at the point of the head center of the listener when the listener is absent.

Figure 3B:
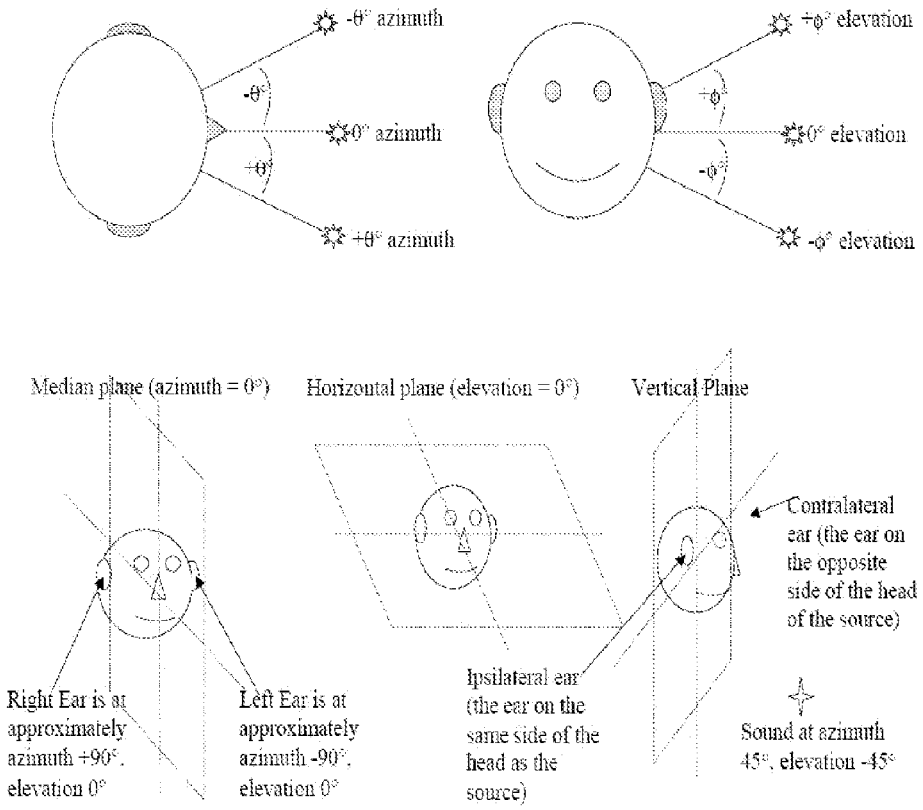

FIG. 3B contains some relevant terminology, and depicts the spatial coordinate system used in much of the HRTF literature, and also in the disclosure. As shown in FIG. 3B, azimuth indicates sound source's spatial direction in a horizontal plane, the front direction (in a median plane passing the nose and perpendicular to a line connecting both ears) is 0 degree, the left direction is 90 degrees and the right direction is −90 degrees. Elevation indicates sound source's spatial direction in the vertical direction. If azimuth corresponds to longitude on the Earth, then elevation corresponds to latitude. A horizontal plane passing both ears corresponds to an elevation of 0 degree, the top of head corresponds to an elevation of 90 degrees.

Research revealed that perception of azimuth (horizontal position) of a sound source mainly depends on IID and ITD, but also depends on spectral cues to some extent. While for perception of elevation of a sound source, the spectral cues, thought to be contributed from the pinnae, play an important role. Psychoacoustic research even revealed that elevation localization, especially in median plane, is fundamentally a monaural process. In the following, elevation localization is taken as an example for illustrating how to spatialize an audio signal with HRTF. For other kinds of spatial rendering involving azimuth localization, the principle is similar.

Figure 3C:
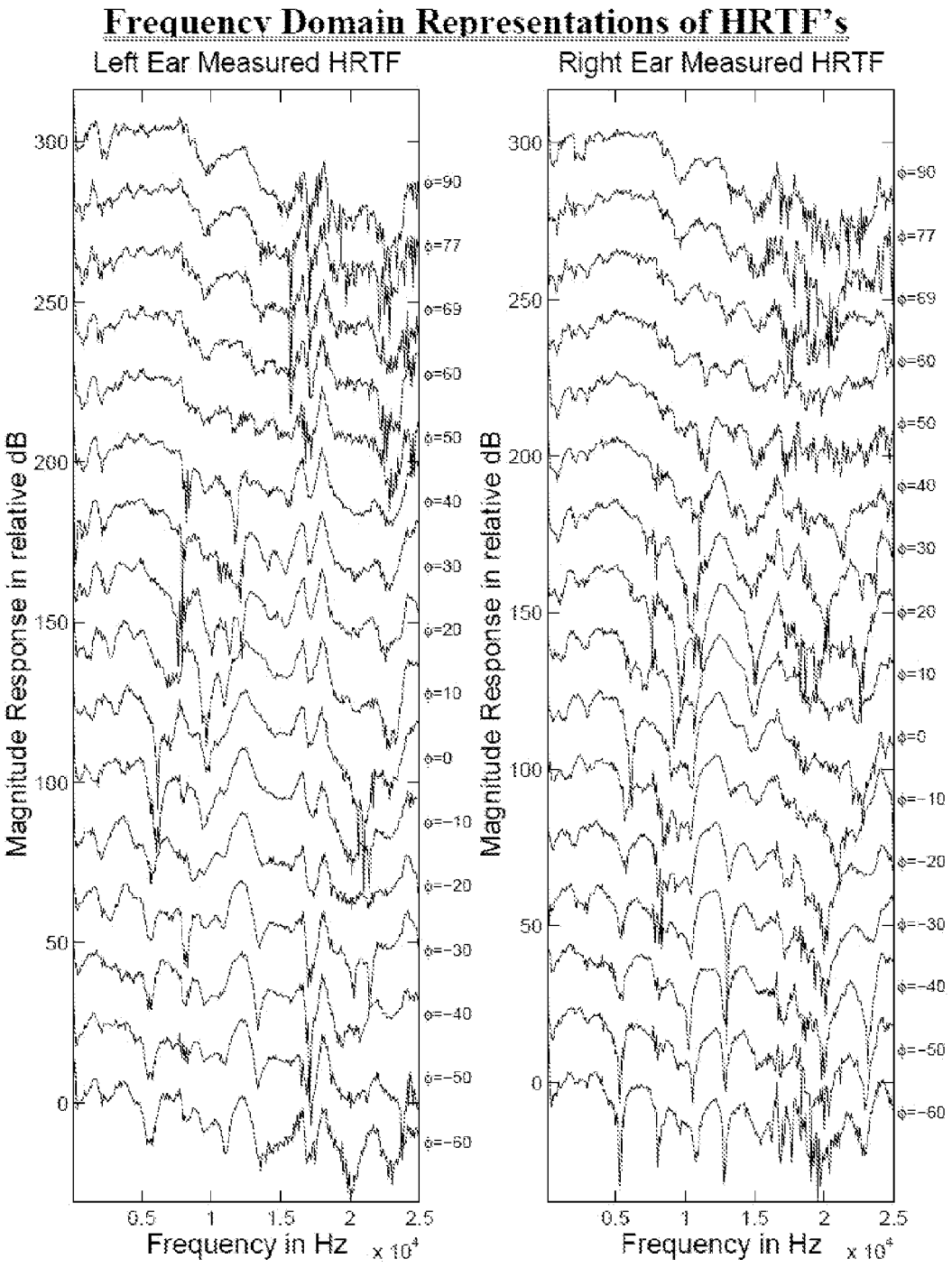

FIG. 3C illustrates frequency domain representations of HRTF as a function of elevation in the median plane (azimuth=0°). There is a notch at 7 kHz that migrates upward in frequency as elevation increases. There is also a shallow peak at 12 kHz which "flattens out" at higher elevations. These noticeable patterns in HRTF data imply cues correlated with the perception of elevation. Of course the notch at 7 kHz and the shallow peak at 12 kHz are just examples for possible elevation cues. In fact, psychoacoustic perception of human being's brain is a very complex process not fully understood up to now. But generally the brain has always been trained by its experience and the brain has correlated each azimuth and elevation with specific spectral response. So, when simulating a specific spatial direction of a sound source, we may just "modulate" or filter the audio signal from the sound source with the HRTF data. For example, given a sound source S located at direction $\phi$, the ear entrance signals $S_{left}$ and $S_{right}$ can be modeled as:

$$\begin{bmatrix} S_{left} \\ S_{right} \end{bmatrix} = \begin{bmatrix} H_{left,\varphi} \\ H_{right,\varphi} \end{bmatrix} \cdot S^T$$

where $H_{left,\phi}$ and $H_{right,\phi}$ are the HRTFs of direction $\phi$. In practice, the HRTFs of a given direction can be measured by using probe microphones inserted at a subject's (either a person or a dummy head) ears to pick up responses from an impulse, or a known stimulus, placed at the direction. These HRTF measurements can be used to synthesize virtual ear entrances signals from a monophonic sound source. By filtering this source with a pair of HRTFs corresponding to a certain direction and presenting the resulting left and right signals to a listener via headphones or earphones, a sound field with a virtual sound source spatialized at the desired direction can be simulated.

For example, when simulating a sound source in the median plane (that is azimuth=0 degree) with an elevation of 0 degree, we may use the spectrum corresponding to $\phi=0$ illustrated in FIG. 3C to filter the audio signal. As mentioned before, spectrum response may also contain azimuth cues. Therefore, through the filtering we may assign an audio signal both azimuth and elevation cues.

Knowing that each spatial direction (a specific pair of azimuth and elevation) corresponds to a specific spectrum, it may be regarded that each spatial direction corresponds to a specific spatial filter making use of the specific spectrum. So, where there are multiple audio signals (such as those from terminals 1 and 2 in FIG. 1), or where there are multiple talkers (such as talkers C and D sharing the terminal 3, as well as talkers A and B using respective terminals 1 and 2 in FIG. 1), it can be understood that the rendering unit 202 can use different spatial filters corresponding to different spatial directions for different audio signals and/or talkers.

About how to use HRTF to spatially render an audio signal, further reference may be made to U.S. Pat. No.

7,391,877B1 granted to Douglas S. Brungart on Jun. 24, 2008 and originally assigned to United States of America as represented by the Secretary of the Air Force, titled "*Spatial Processor for Enhanced Performance in Multi-talker Speech Displays*", which is incorporated herein in its entirety by reference.

Alternatively or additionally, the rendering unit 202 may be configured to spatially render the audio stream based on the ratio of direct-to-reverberation energy. Reverberation can provide a cue to sound source distance arising from changes in the ratio of the direct to reverberant sound energy level. This ratio varies with the sound source distance. In particular, as source distance is increased, the level of the sound reaching a listener directly will decrease, leading to a reduction in the ratio of direct to reverberant energy. Therefore, for spatially rendering an audio signal so that the reproduced sound sounds like originating from a sound source at a predetermined distance, we can simulate the effect of reverberation corresponding to the distance within a specific space, such as a specific meeting room. An example of such technique may be found in U.S. Pat. No. 7,561,699B2 granted to Jean-Marc Jot et al. on Jul. 14, 2009 and originally assigned to Creative Technology Ltd, titled "*Environmental reverberation processor*", which is incorporated herein in its entirety by reference.

In the description above it could be noted that both distance and direction of the rendered talker are mentioned. In the context of the present application, either for the virtual position of a rendered sound source (talker) or the real position of a real sound source (talker), the term "position" may refer to only direction, or only distance, or both direction and distance.

The real position obtaining unit 204 is configured to obtain a real spatial position of a real sound source. In the scenarios shown in FIG. 1, the real sound source may be a noise sound source such as an air conditioner, other non-conference-participating talkers, or other conference-participating talkers, in the same room. The real position obtaining unit 204 may comprise an input unit via which a user may input the position of the real sound source.

Alternatively or additionally, the real position obtaining unit 204 may be configured to obtain the real spatial position of the real sound source automatically. There are many existing techniques to do this. As an example, the real position obtaining unit 204 may comprise a microphone array and is configured to estimate the real spatial position of the real sound source based on the sounds captured by the microphone array and using a direction-of-arrival (DOA) algorithm. A DOA algorithm estimates the direction of arrival based on phase, time, or amplitude difference of the captured signals. There are many techniques for estimating DOA.

One kind of DOA algorithm is TDOA (time-difference-of-arrival algorithm). There are many techniques for locating a sound source using TDOA, such as DUAN Jinghong et al., "*Sound Source Location Based On BP Neural Network And TDOA*", Telecommunication Engineering, Vol. 47 No. 5, October 2007, which is incorporated herein in its entirety by reference. For estimation of TDOA, there are also many techniques, such as the generalized cross correlation-phase transform (GCC-PHAT) algorithm, see XIA Yang et al., "*A Rectangular Microphone Array Based Improved GCC-PHAT Voice Localization Algorithm*", Shandong Science, Vol. 24 No. 6 December, 2011, which is incorporated herein in its entirety by reference. Other examples of DOA estimation includes Steered Response Power-Phase Transform (SRP-PHAT), MUiltiple SIgnal Classification (MUSIC), etc.

The comparator 206 is configured to compare the real spatial position with the at least one virtual spatial position, to see whether the real spatial position of the real sound source will interfere with the at least one virtual spatial position of the reproduced far-end sound. There are three situations. The first is the two occupy the same spatial position. The second is the two are very close to each other. The third is one of the two is between the other and the listener and thus shadows the other from the listener. The third situation includes not only the case where the real sound source is located between the listener and the virtual spatial position of the reproduced far-end sound, but also the case where the virtual spatial position is located between the listener and the real sound source. Certainly, one of the two is not necessarily located exactly on the line connecting the listener and the other, but may be just close to the line to be enough to interfere with the other. We can generalize the three situations as: one of the two is within a predetermined range around the other, where of course the predetermined range is not necessarily a regular shape. In addition, the predetermined range may depend on the loudness of the real sound source and/or the reproduced far-end sound, and/or the loudness ratio between the real sound source and the reproduced far-end sound. If the loudness and/or loudness ratio makes the two more susceptible to interfere with each other, then the predetermined range will be larger.

If the result of the comparator 206 shows that the real spatial position of the real sound source is within a predetermined range around the at least one virtual spatial position, or vice versa, then the adjusting unit 208 adjusts the parameters of the rendering unit 202 so that the at least one virtual spatial position is changed, thus making the reproduced far-end sound (as well as the real sound source) more intelligible.

As mentioned before, the rendering unit 202 may spatially render the audio stream based on at least one of HRTF, IID, ITD, and direct-to-reverberation energy ratio. In doing so, it can be regarded that the rendering unit 202 uses different filters corresponding to required virtual spatial positions. Therefore, when mentioning "parameters" of the rendering unit 202, it can be either understood as the required spatial positions, or parameters for calling different filters.

As mentioned before, if the audio signal to be rendered by the rendering unit 202 is an original stereo/sound field signal, or has been spatialized, then the rendering unit 202 may simply reproduce the original/spatialized stereo/sound field signal. However, when involving re-positioning the virtual spatial position of the reproduced far-end sound, different far-end sound sources (such as far-end talkers) may be firstly separated, and then spatially rendered by properly selected filters. There are many separating techniques for doing this. For example, blind signal separation (BSS) techniques may be used to differentiate different talkers. One of such techniques may be found in, but definitely not limited to, X. J. Sun, "*Methods and Apparatuses for Convolutive Blind Source Separation*", CN patent application published as CN102903368A, which is incorporated herein in its entirety by reference.

Alternatively, the whole sound field may be rotated, translated, squeezed, extended or otherwise transformed. In such a situation, the parameters to be adjusted may include the orientation and/or width or any other parameters of the sound field, which may be calculated from the intended virtual position of the reproduced far-end sound source, knowing that once the whole sound field moves/rotates/zooms/transforms, the virtual positions of the reproduced far-end sound sources will change accordingly.

There are many matured techniques for performing rotation, translation, compression, extension or other transformation of a sound field. As an example, sound field rotation can be easily achieved on the 3-channel B-format signals using standard rotation matrix as below:

$$\begin{bmatrix} W' \\ X' \\ Y' \end{bmatrix} = \begin{bmatrix} 1 & 0 & 0 \\ 0 & \cos(0) & -\sin(0) \\ 0 & \sin(\theta) & \cos(\theta) \end{bmatrix} \begin{bmatrix} W \\ X \\ Y \end{bmatrix}$$

where W is omnidirectional information, X and Y are two directional information. θ is the rotation angle.

As mentioned before, the term "position" in the present application may mean direction and/or distance. Therefore, the adjusting unit 208 may be configured to adjust the parameters of the rendering unit 202 so that the at least one virtual spatial position is rotated around the listener away from the virtual spatial position, and/or the at least one virtual spatial position is moved to a position closer to the listener.

Figure 4A:
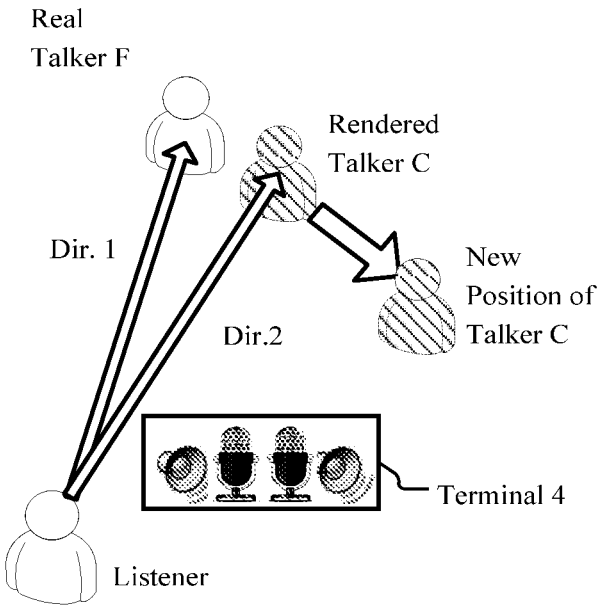
FIGS. 4A and 4B are diagrams illustrating two specific examples of the embodiment as illustrated in FIG. 2.

As shown in FIG. 4A, the elements of which are extracted from FIG. 1, if the spatial positions (directions 1 and 2, respectively) of real talker F and rendered talker C are too close to each other, then the rendering unit 202 may be adjusted to separate the audio signal of talker C and re-render him/her to the new position, as shown with the wider arrow in FIG. 4A. This can be related to a listener on headphones or earphones rotating his head when there is a stationary point noise source or a temporarily stationary real talker in the listening environment such as a meeting room. The noise or the real talker will remain in the same location but the rendered scene on the headphones/earphones will move with the listener's head rotation. Then, at some time, the virtual position of a rendered talker is properly spaced apart from the noise or the real talker, but at some other time, the listener rotates his head and possibly places the rendered talker too close to the noise or the real talker, and thus the rendering unit 202 need be adjusted to re-position the rendered talker. Also possible is the real talker moves his/her position in the meeting room, and the situation is similar.

Figure 4B:
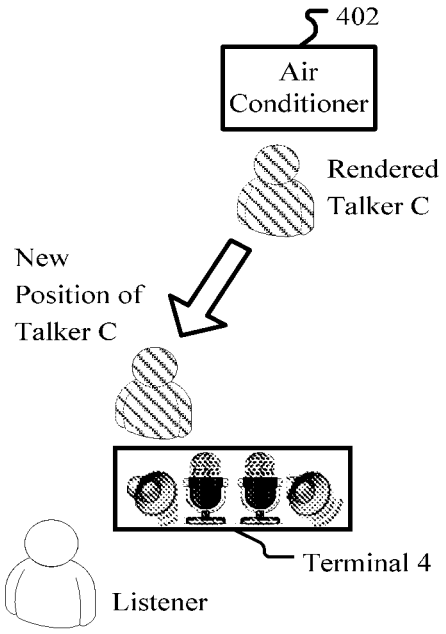

FIG. 4B shows another scenario where adjustment of the virtual position of a rendered far-end sound may be necessary. There is a stationary noise source, such as an air conditioner 402. Rendered talker C may be too close to the air conditioner 402 to be intelligible. Then the rendering unit 202 (which may be embodied in terminal 4) may separate the audio signal of talker C and re-position him/her to a new position closer to the listener. It can also be envisaged to move the render talker C in the same manner as in FIG. 4A.

The adjustment discussed in the present application may be performed at any time, including in a calibration stage of the audio spatial rendering apparatus. In the calibration stage, for stationary sound sources in the listening environment, such as an air conditioner in a meeting room, the real position obtaining unit 204, the comparator 206, and the adjusting unit 208 work as usual. But for non-stationary sound sources, such as real talkers who have not come into the meeting room, since there is no real voices, the real position obtaining unit 204 may use the input unit as discussed before.

During the progress of the conference call, the real position obtaining unit 204, the comparator 206 and the adjusting unit 208 can work in real time, or be trigged manually when the near-end listener/talker realizes such necessity.

In the calibration stage, the virtual positions of the rendered sound sources may be adjusted to desired positions fast. But in the real-time adjustment, the adjusting unit 208 may be configured to change the virtual spatial position gradually. Changing the virtual direction of the target speech rapidly will likely result in degraded perceptual experience. For avoiding artifacts, it is also possible that the adjusting unit 208 performs the change during pauses of the far-end sound (this will be discussed later). Also, for making the change not so abrupt, the angle change may be reasonably small. For example, one degree of separation between the target location and the local interferer's location could be sufficient.

Detection of Real Sound Sources

Hereinbefore have been discussed how to spatially render the audio stream and how to estimate the spatial position of the real sound source. Spatial position estimation of the real sound source may also be regarded as a process of determining the existence of the real sound source. However, for detecting the real sound source, there may be three interfering factors: reproduced far-end sound captured by the near-end microphones for detecting the real sound source, that is, echo of the far-end sound; voice of the near-end talker; and occasional interruptions.

Echo of Far-End Sound

Figure 5:
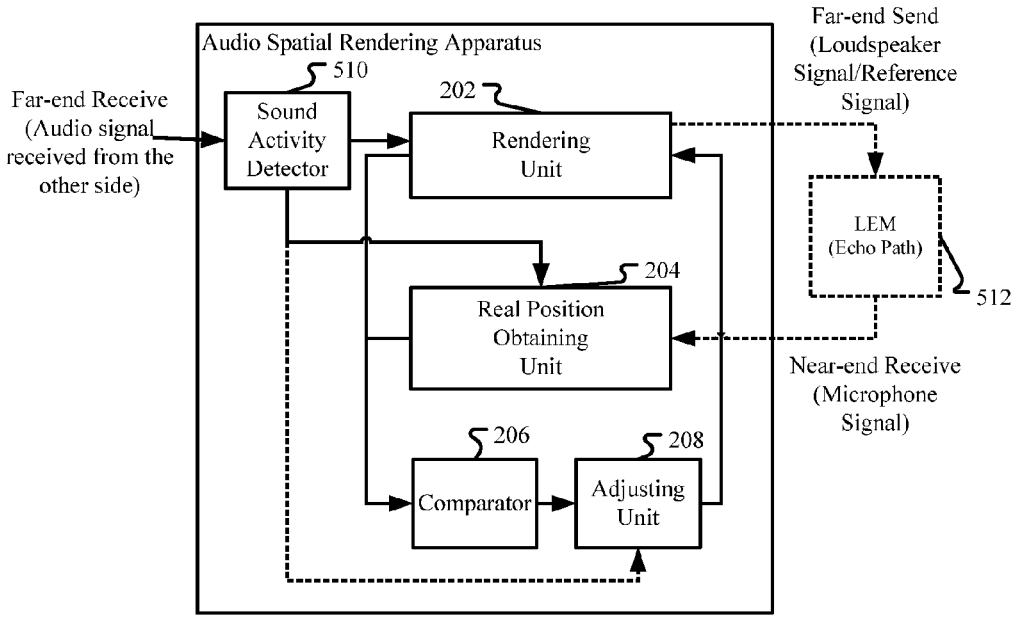
FIGS. 5-8 are diagrams illustrating an audio spatial rendering apparatus according to further embodiments of the application.

In the case where a far-end audio stream is reproduced by a loudspeaker or a loudspeaker array as a part of the rendering unit 202, as shown in FIG. 5, the loudspeaker signal may be captured by the microphone array of the real position obtaining unit 204 after passing through the echo path LEM (Loudspeaker-Enclosure-Microphone) 512. Then, the real position obtaining unit 204 may be confused and cannot distinguish real sound sources from the captured echo of the far-end sound. (When the real position obtaining unit 204 comprises an input unit for directly inputting spatial positions of the real sound sources as discussed before, there will be no such confusion.)

One countermeasure is the real position obtaining unit 204 may be configured to work when there is no far-end sound. Then, as shown in FIG. 5, the audio spatial rendering apparatus may further comprise a sound activity detector 510 for detecting the existence of far-end sounds. That is, when there are far-end sounds, the rendering unit 202 may reproduce the far-end sounds and at the same time obtain the virtual position of the rendered far-end sound source. When there are no far-end sounds, the real position obtaining unit 204 works to obtain the real spatial positions of local real sound sources. In this way, the influence of the far-end sounds on the detection of real sound sources is avoided.

The sound activity detector 510 may be implemented with many existing techniques, such as WANG Jun et al., "*Codec-Independent Sound Activity Detection Based On The Entropy With Adaptive Noise Update*", 9th International Conference on Software Process (ICSP 2008) on 26-29 Oct. 2008, which is incorporated herein in its entirety by reference. When only voice of speech is involved, such as in an audio conferencing system, the sound activity detector 510 is just a voice activity detector (VAD), which also may be implemented with many existing techniques.

Incidentally, based on the result of the sound activity detector 510 or the VAD, the adjusting unit 208 may also be configured to adjust the rendering unit 202 during the pause of the far-end sound, so as to avoid artifacts or avoid making the change too abrupt, as mentioned before.

Figure 6:
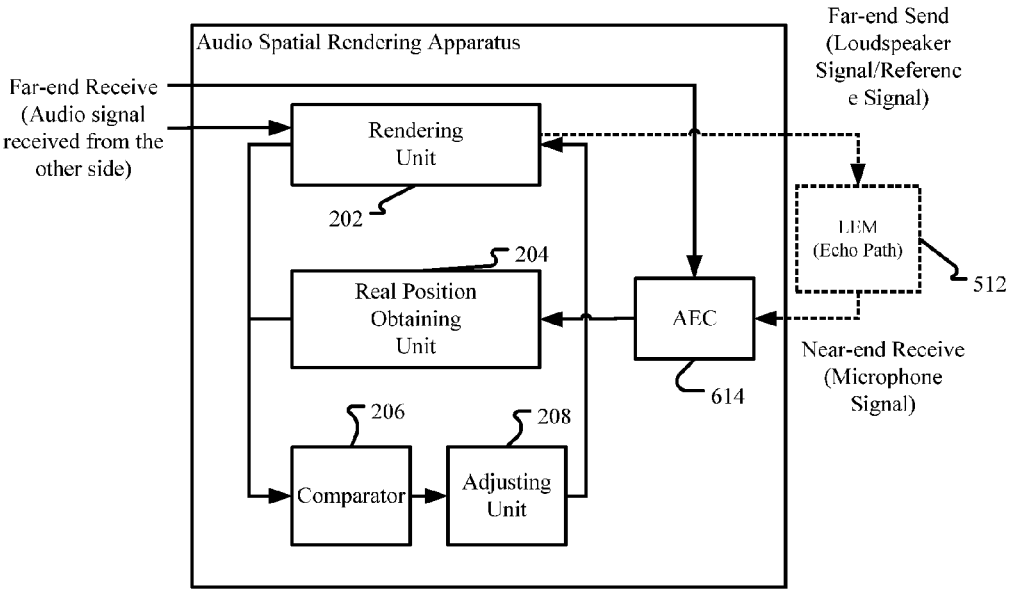

The other countermeasure is to use an acoustic echo cancellation device 614 (FIG. 6) for cancelling captured echo of the reproduced far-end sound, and the real position obtaining unit 204 is configured to take the residual signal after the processing of the acoustic echo cancellation (AEC) device as the signal from the real sound source. There are many existing techniques for realizing the acoustic echo cancellation device 614.

Voice of the Near-End Talker

In the context of the present application, "near-end talker" refers to the real talker in the listening environment who is also the listener, such as who wears headphones/earphones incorporating one instance of the solutions of the present application, or who uses a computer incorporating one instance of the solutions of the present application. The other real talkers as the real sound sources may also listen, but they are regarded as "near-end talker" only with respect to their own headphones/earphones/computer incorporating other instances of the solutions of the present application. In the scenarios where a loudspeaker array is comprised of loudspeakers scattered in the listening environment, maybe all the real talkers are regarded as read sound sources in the present application and there is no near-end talker.

In some scenarios, the near-end talker shall be excluded from the detection of the real position obtaining unit 204, otherwise the adjusting unit 208 will do some unnecessary adjustments.

According to the definition of "near-end talker" as discussed above, we can know that generally the near-end talker will be within a predetermined range around the microphone array. Therefore, for excluding the near-end talker's voice, the adjusting unit is configured not to adjust the parameters of the rendering unit when the real spatial position is inside a predetermined spatial range. For doing so, the comparator 206 may be configured to not only compare the real spatial position of the real sound source and the virtual spatial position of the reproduced far-end sound, but also compare the real spatial position with the predetermined spatial range. When the real spatial position of the real sound source is within the predetermined spatial range, then the corresponding real sound source is regarded as the near-end talker and will not be considered by the adjusting unit 208. When the real spatial position of the real sound source is outside the predetermined spatial range, the corresponding real sound source will be considered by the adjusting unit 208 and further if the real spatial position and the virtual spatial position are too close to each other, the adjusting unit 208 will adjust the rendering unit 202 to move the virtual spatial position away from the real sound source.

Consider a laptop computer as an example. A laptop computer is normally equipped with a linear microphone array, e.g. a 2-microphone array. Far-end signals are played back through laptop built-in loudspeakers, a pair of desktop loudspeakers, or a pair of stereo headphones. With the microphone array, we can use conventional DOA methods such as phase based GCC-PHAT, or subspace based methods such as MUSIC. We assume the user (near-end talker) sits in front of the laptop, then the position of the near-end talker signal is approximately in the median plane between the microphone array (0 degree, broad side direction). Then, we can estimate that a real sound source is not the near-end talker if the estimated DOA is not of 0 degree or outside of a pre-defined range around 0 degree.

For headphones/earphones with a microphone array, the situation is similar where a pre-defined spatial position of the near-end talker can be obtained.

Figure 7:
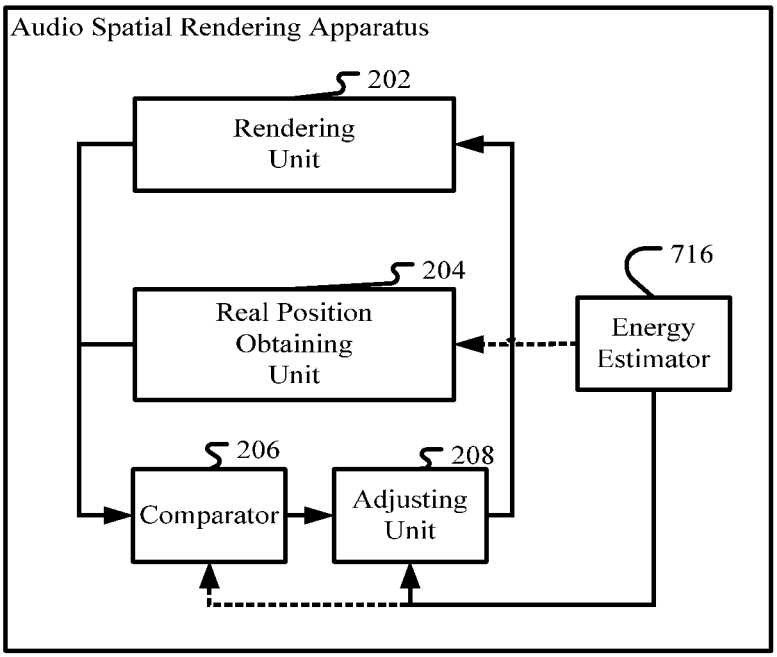

To further improve the accuracy, the energy of the audio signal captured by the microphone array may be considered. The captured signal of a real sound source would normally has lower energy than near-end speech signal due to distance. For example, if the microphone signal has an estimated direction outside of the 0 degree zone but still has very high energy, it is not classified as a real sound source thus no change of the virtual spatial position is performed. For doing this, as shown in FIG. 7, the audio spatial rendering apparatus may further comprise an energy estimator 716 for estimating signal energy of the real sound source, and the adjusting unit 208 is configured not to adjust the parameters of the rendering unit 202 when the estimated energy is higher than a predetermined threshold. As shown in FIG. 7, to make the adjusting unit 208 not adjust the rendering unit 202, the energy estimator 716 may directly disable the adjusting unit 208 itself, but also may alternatively or additionally disable the real position obtaining unit 204 and/or the comparator 206. Note that here, "disablement" is just with respect to the real sound source the estimated energy of which is higher than the predetermined threshold. For the other real sound sources, the real position obtaining unit 204, the comparator 206 and the adjusting unit 208 still work normally.

Occasional Interruptions

Figure 8:
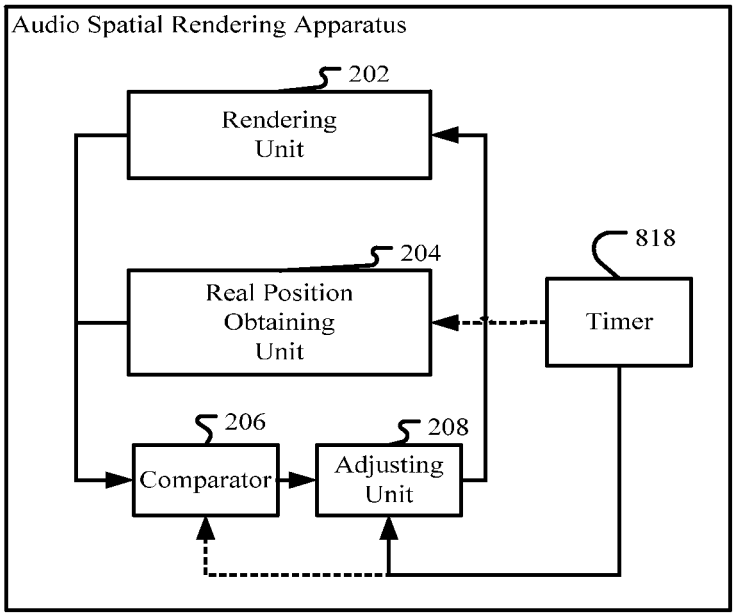

The system may be further modified to be tolerant of occasional interruptions in the listening environment, such as a participant in the room sneezing or coughing, other occasional non-speech sounds within the room such as a mobile phone ringing, and occasional movement of active talkers. The differentiation between whether to regard a real sound source as moved or keep it in place could be determined by time based thresholds. For example, a real sound source is only regarded as moved if the movement thereof lasts more than a predetermined time period, and a new real sound source is regarded active only if it lasts more than a predetermined time period. Therefore, as shown in FIG. 8, the audio spatial rendering apparatus may further comprise a timer 818 for determining a length of time of the lasting of the real sound source, and the adjusting unit 208 is configured not to adjust the parameters when the length of time is less than a predetermined threshold.

Here, similar to the energy estimator 716 in FIG. 7, to make the adjusting unit 208 not adjust the rendering unit 202, the timer 818 may directly disable the adjusting unit 208 itself, but also may alternatively or additionally disable the real position obtaining unit 204 and/or the comparator 206. Note that here, "disablement" is just with respect to the real sound source the lasting time of which is less than the predetermined threshold. For the other real sound sources, the real position obtaining unit 204, the comparator 206 and the adjusting unit 208 still work normally.

Combination of Embodiments and Application Scenarios

All the embodiments and variants there of discussed above may be implemented in any combination thereof, and any components mentioned in different parts/embodiments but having the same or similar functions may be implemented as the same or separate components.

Specifically, when describing the embodiments and their variations hereinbefore, those components having reference signs similar to those already described in previous embodiments or variants are omitted, and just different components are described. In fact, these different components can either be combined with the components of other embodiments or variants, or constitute separate solutions alone. For example, any two or more of the solutions described with reference to FIGS. 5 to 8 may be combined with each other. As the most complete solution, the audio spatial rendering apparatus may comprise the sound activity detector 510 so that the adjusting unit 208 works only when there is no far-end sound. At the same time, the audio spatial rendering apparatus may further comprise the AEC 614, the energy estimator 716 and the timer 818.

As mentioned before, the present application may be applied in an audio reproducing apparatus such as headphones, earphones, a loudspeaker and a loudspeaker array. These audio reproducing apparatus may be used for any purpose, such as in an audio conferencing system. They can also be used in an audio system of theatre or cinema. When involving music, it may not be rendered to one single location or compressed too much, and the rendered sound sources (such as various instruments) should remain spaced apart from each other during movements.

Figure 9:
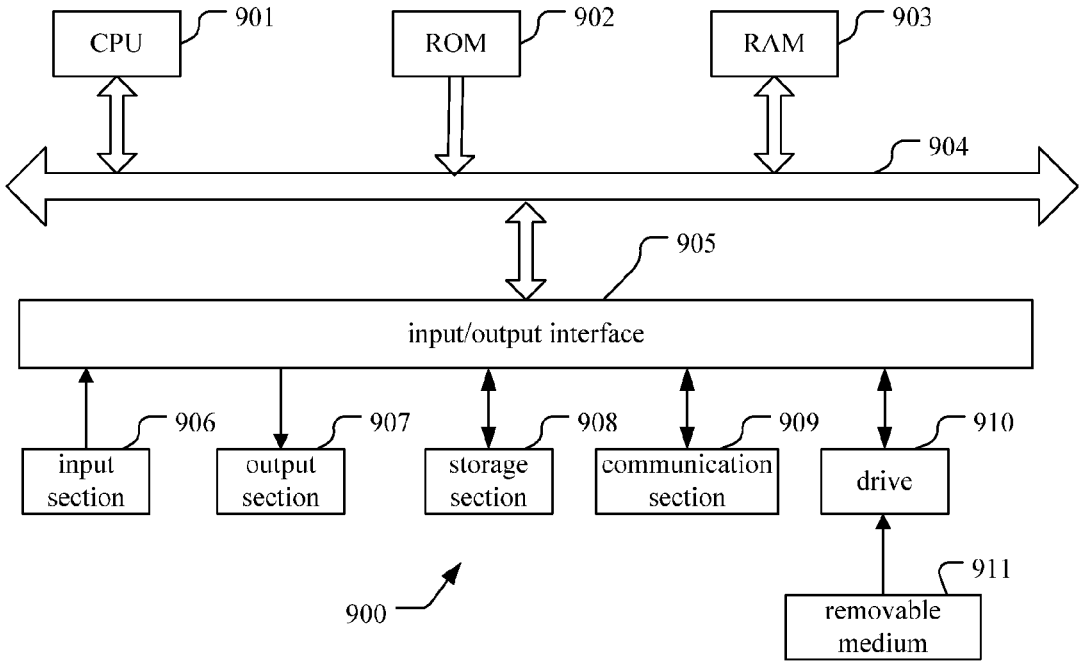
FIG. 9 is a block diagram illustrating an exemplary system for implementing embodiments of the present application.

As discussed at the beginning of the Detailed Description of the present application, the embodiment of the application may be embodied either in hardware or in software, or in both. FIG. 9 is a block diagram illustrating an exemplary system for implementing the aspects of the present application.

In FIG. 9, a central processing unit (CPU) 901 performs various processes in accordance with a program stored in a read only memory (ROM) 902 or a program loaded from a storage section 908 to a random access memory (RAM) 903. In the RAM 903, data required when the CPU 901 performs the various processes or the like are also stored as required.

The CPU 901, the ROM 902 and the RAM 903 are connected to one another via a bus 904. An input/output interface 905 is also connected to the bus 904.

The following components are connected to the input/output interface 905: an input section 906 including a keyboard, a mouse, or the like; an output section 907 including a display such as a cathode ray tube (CRT), a liquid crystal display (LCD), or the like, and a loudspeaker or the like; the storage section 908 including a hard disk or the like; and a communication section 909 including a network interface card such as a LAN card, a modem, or the like. The communication section 909 performs a communication process via the network such as the internet.

A drive 910 is also connected to the input/output interface 905 as required. A removable medium 911, such as a magnetic disk, an optical disk, a magneto-optical disk, a semiconductor memory, or the like, is mounted on the drive 910 as required, so that a computer program read there from is installed into the storage section 908 as required.

In the case where the above-described components are implemented by the software, the program that constitutes the software is installed from the network such as the internet or the storage medium such as the removable medium 911.

Audio Spatial Rendering Method

In the process of describing the audio spatial rendering apparatus in the embodiments hereinbefore, apparently disclosed are also some processes or methods. Hereinafter a summary of these methods is given without repeating some of the details already discussed hereinbefore, but it shall be noted that although the methods are disclosed in the process of describing the audio spatial rendering apparatus, the methods do not necessarily adopt those components as described or are not necessarily executed by those components. For example, the embodiments of the audio spatial rendering apparatus may be realized partially or completely with hardware and/or firmware, while it is possible that the audio spatial rendering method discussed below may be realized totally by a computer-executable program, although the methods may also adopt the hardware and/or firmware of the audio spatial rendering apparatus.

The methods will be described below with reference to FIGS. 10-15. Please note that in correspondence to the streaming property of the audio signal, the various operations are repeated when the method is implemented in real time, and different operations are not necessarily with respect to the same audio segment, but with respect to relevant real sound sources and relevant rendered/virtual sound sources in the listening environment.

Figure 10:
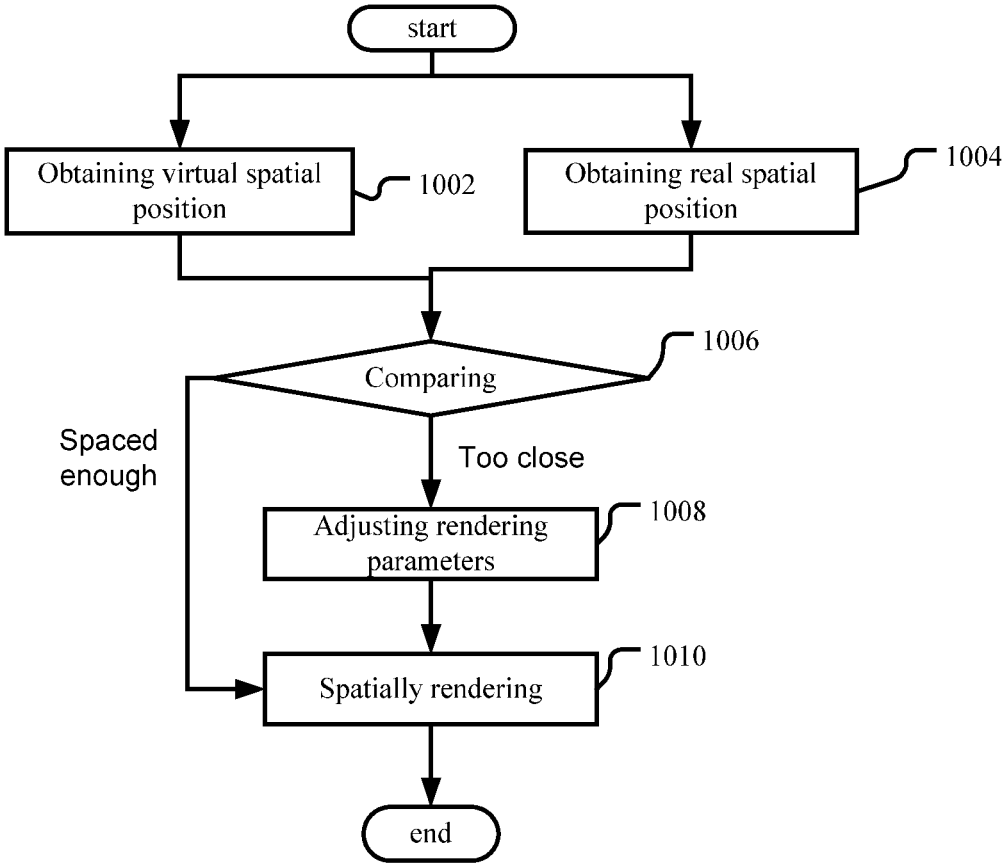
FIGS. 10-15 are flow charts illustrating an audio spatial rendering method according to embodiments of the present application.
Figure 11:
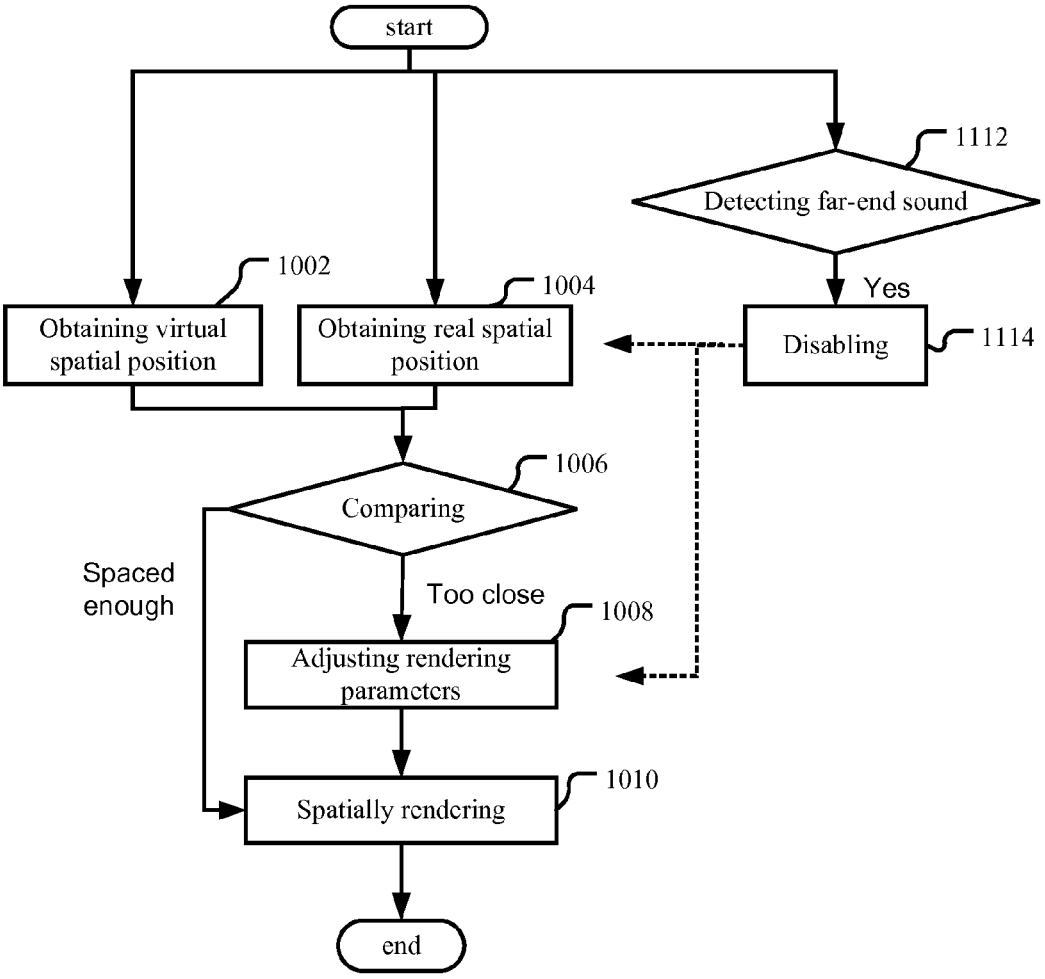
Figure 12:
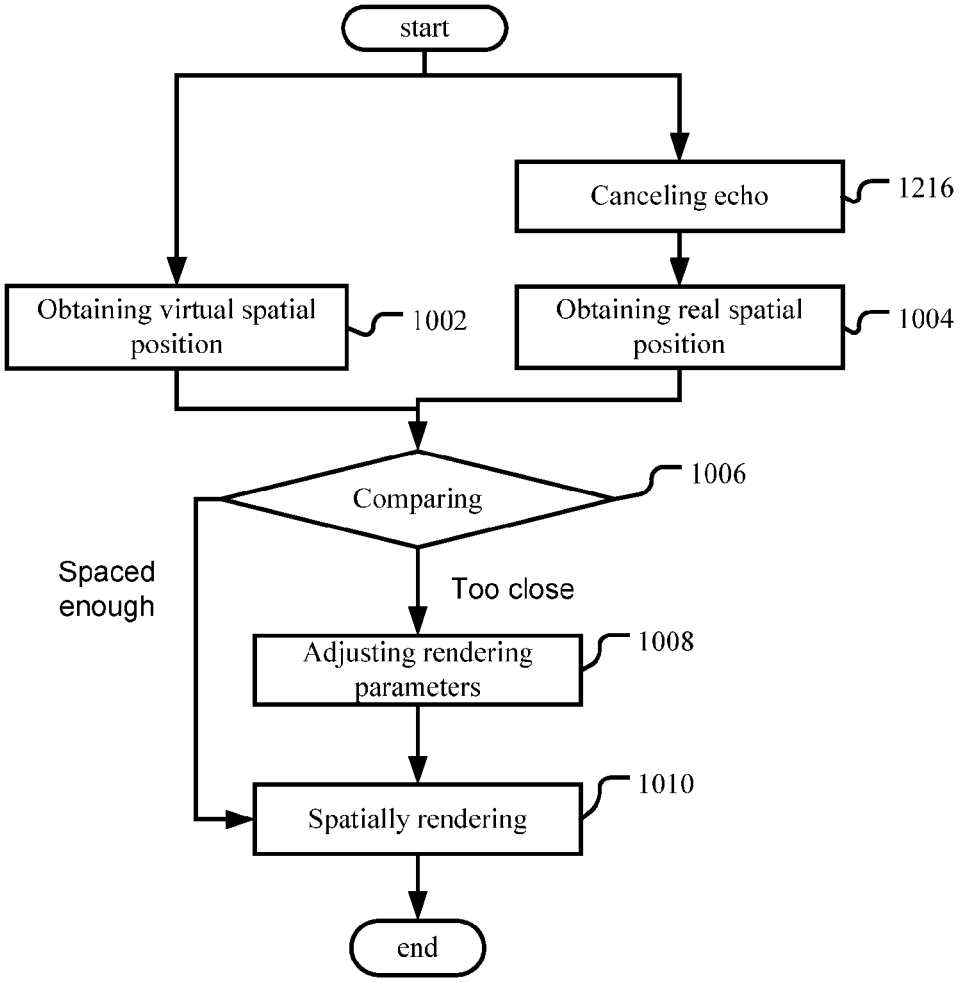

In an embodiment as shown in FIG. 10, an audio spatial rendering method is provided. First, at least one virtual spatial position from which a reproduced far-end sound to be spatially rendered from an audio stream is perceived by a listener as originating is obtained (operation 1002), and a real spatial position of a real sound source is also obtained (operation 1004). The sequence of these two operations does not matter, either may be the first and they can also be performed in parallel. As discussed when describing the audio spatial rendering apparatus, the virtual spatial position of a rendered sound source may be either determined at the side of the far-end terminal, or the server, or at the side of the near-end terminal (the audio spatial rendering apparatus of the present application). In either case, the rendering unit of the audio spatial rendering apparatus will know, or determine, or can derive the virtual spatial position of the rendered sound source. Then, the real spatial position is compared with the at least one virtual spatial position (operation 1006). If the real spatial position is within a predetermined range around the at least one virtual spatial position or vice versa, meaning that the real spatial position will interfere with the at least one virtual spatial position, the parameters for spatial rendering will be adjusted (operation 1008) so that the at least one virtual spatial position is changed. Then the subsequent audio stream is spatially rendered based on the adjusted parameters (operation 1010).

The operation of obtaining the virtual spatial position (operation 1002) and the operation of spatially rendering the audio stream (operation 1010) may be based on a head-related transfer function and/or an inter-aural time difference and/or an inter-aural intensity difference. The ratio of direct-to-reverberation energy may also be used.

For getting the real spatial position of the real sound source, an input unit may be used to get the user's input about the specific position of a real sound source, or to get the user's indication about which detected sound source is the real sound source to be considered rather than the near-end talker or the loudspeaker of the audio rendering apparatus.

The real spatial position of the real sound source may also be estimated based on sounds captured by a microphone array and using a direction-of-arrival (DOA) algorithm. Specifically, a generalized cross correlation-phase transform (GCC-PHAT) algorithm, Steered Response Power-Phase Transform (SRP-PHAT) or MUltiple SIgnal Classification (MUSIC) may be used.

For making the real sound source not interfere with the rendered far-end sound source, the parameters may be adjusted so that the at least one virtual spatial position is rotated around the listener away from the virtual spatial position, and/or the at least one virtual spatial position is moved to a position closer to the listener, respectively as shown in FIG. 4A and FIG. 4B.

The method of the present embodiment may be performed in a calibration stage or in real time. When performed in real time, it should be noted that the parameters may be adjusted in a manner of changing the at least one virtual spatial position gradually, so as not to incur artifacts, or not to make the change too abrupt. An alternative way is to do the adjustment (operation 1008 in FIG. 11) when there is no far-end sound, such as during the pause of the far-end speech in an audio conferencing system. That is, the operation of adjusting the parameters (operation 1008) may be disabled (operation 1114) when a far-end sound (or far-end speech) is detected ("Yes" in the operation 1112).

To make the control more accurate, it is important to make the detection of the real sound source more reliable. Then, the influence of the captured echo of the far-end sound on the detection of the real sound source shall be cancelled. One solution is to detect the start and end of a far-end sound in the audio stream (operation 1112 in FIG. 11), and the operation of obtaining the real spatial position of the real sound source is performed when there is no far-end sound. That is, the operation of obtaining the real spatial position (operation 1004) may be disabled (operation 1114) when a far-end sound is detected ("Yes" in the operation 1112).

The detection of the far-end sound may be implemented with any existing techniques. When an audio conferencing system is involved, VAD techniques may be used to detect the start and end of a far-end speech in the audio stream, and the operation of obtaining the real spatial position of the real sound source is performed when there is no far-end speech.

Another countermeasure is acoustic echo cancellation (AEC). That is, the captured echo of the reproduced far-end sound may be cancelled (operation 1216 in FIG. 12), and the operation of obtaining the real spatial position (operation 1004) is configured to take the residual signal after the operation of cancelling the captured echo as the signal from the real sound source. In this way, the spatial position of the loudspeaker will not be confused with the spatial position of the real sound source.

Figure 13:
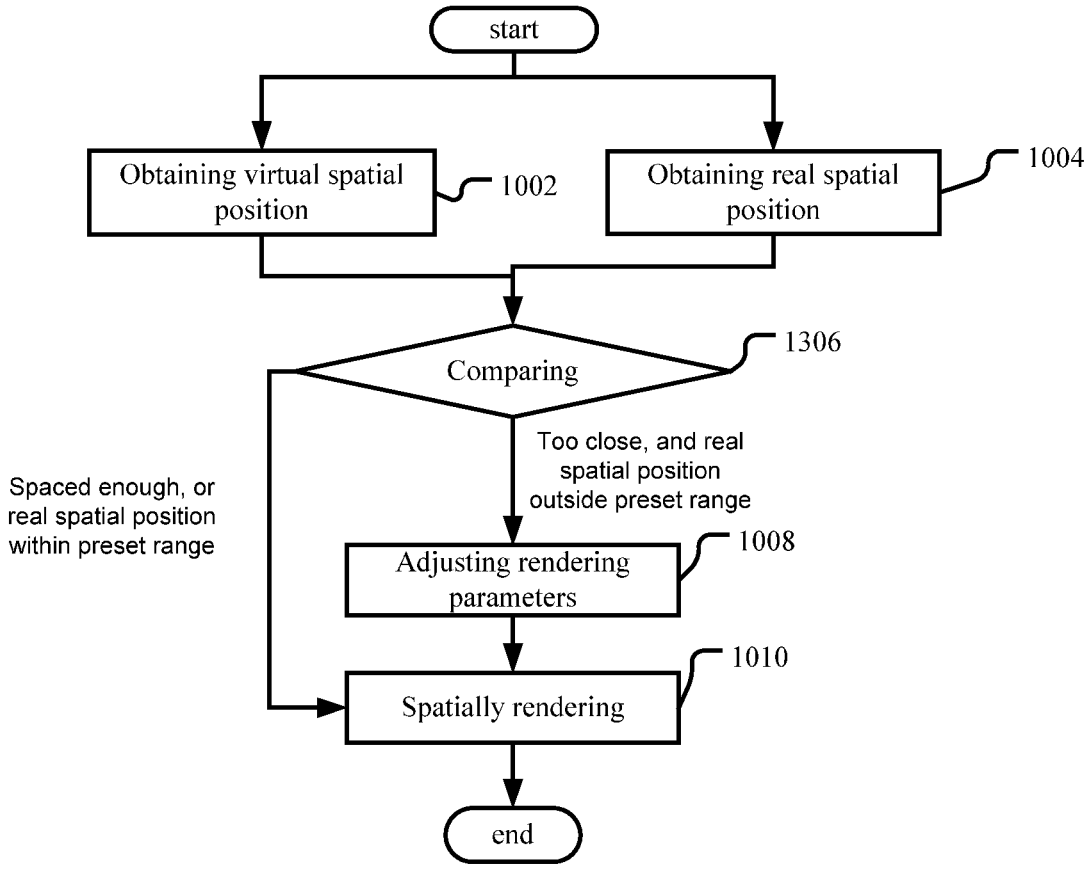

In some scenarios, the near-end talker shall be excluded from the real sound sources. The spatial position or the energy of the near-end talker may be considered. Considering that the near-end talker is likely near to the microphone array and his/her spatial location relative to the microphone array is known and stable, a real sound source within a predetermined spatial range may be regarded as the near-end talker, and thus may not trigger rendering parameters adjustment. Therefore, in the embodiment as shown in FIG. 13, the operation of comparing (operation 1306) may be configured to do both comparison between the real spatial position and the virtual spatial position, and comparison between the real spatial position and the predetermined spatial range.

Figure 14:
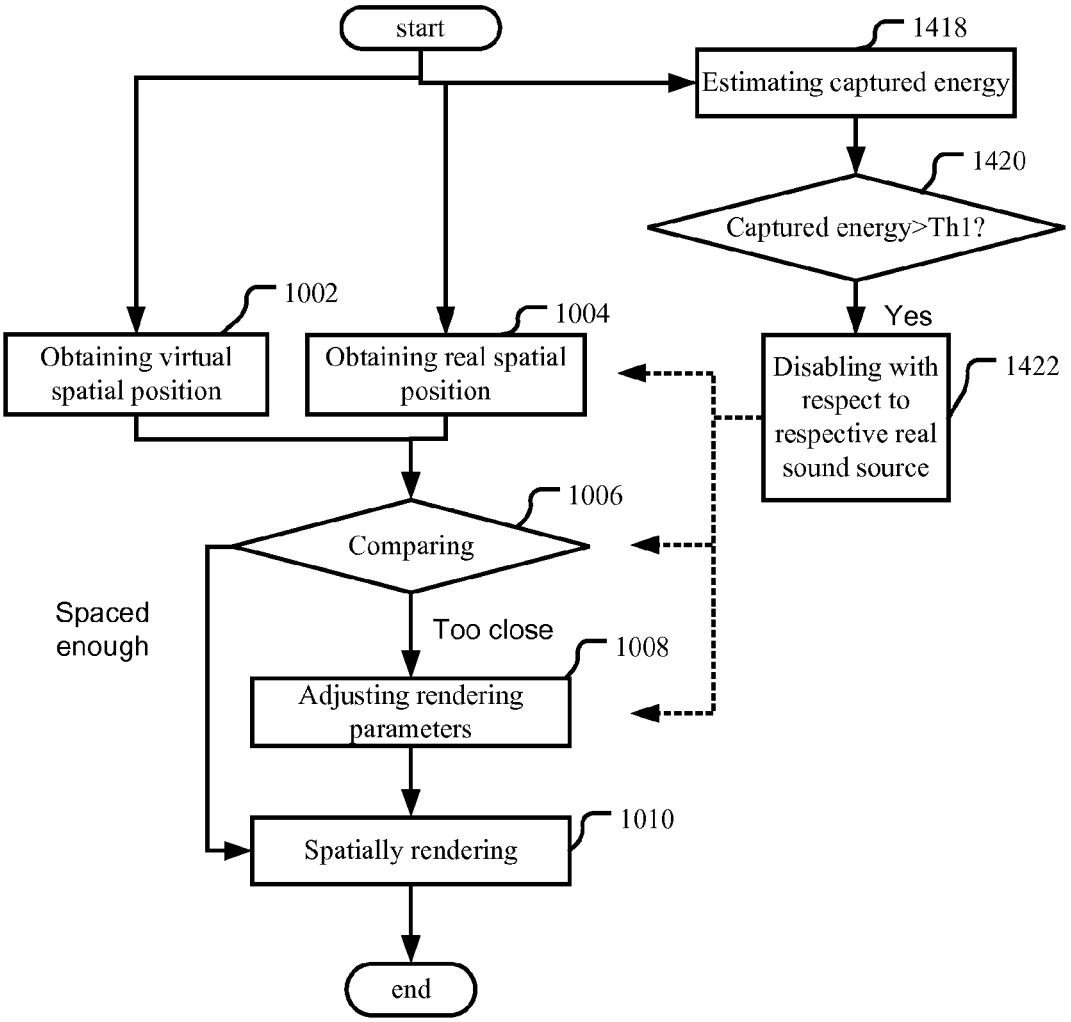

To further improve the accuracy, the energy of the signal captured by the microphone array may be considered. As shown in FIG. 14, the method may further comprise estimating energy of the real sound source (operation 1418 in FIG. 14), and the parameters are not adjusted when the estimatedenergy is higher than a predetermined threshold Th1 ("Yes" in the operation 1420). As shown in FIG. 14, to make the parameters not adjusted, any of the operation of obtaining the real spatial position (operation 1004), the operation of comparing (operation 1006) and the operation of adjusting the rendering parameters (operation 1008) may be disabled. Note that here, "disablement" is just with respect to the real sound source the energy of which is higher than the predetermined threshold. For the other real sound sources, these operations still work normally.

Figure 15:
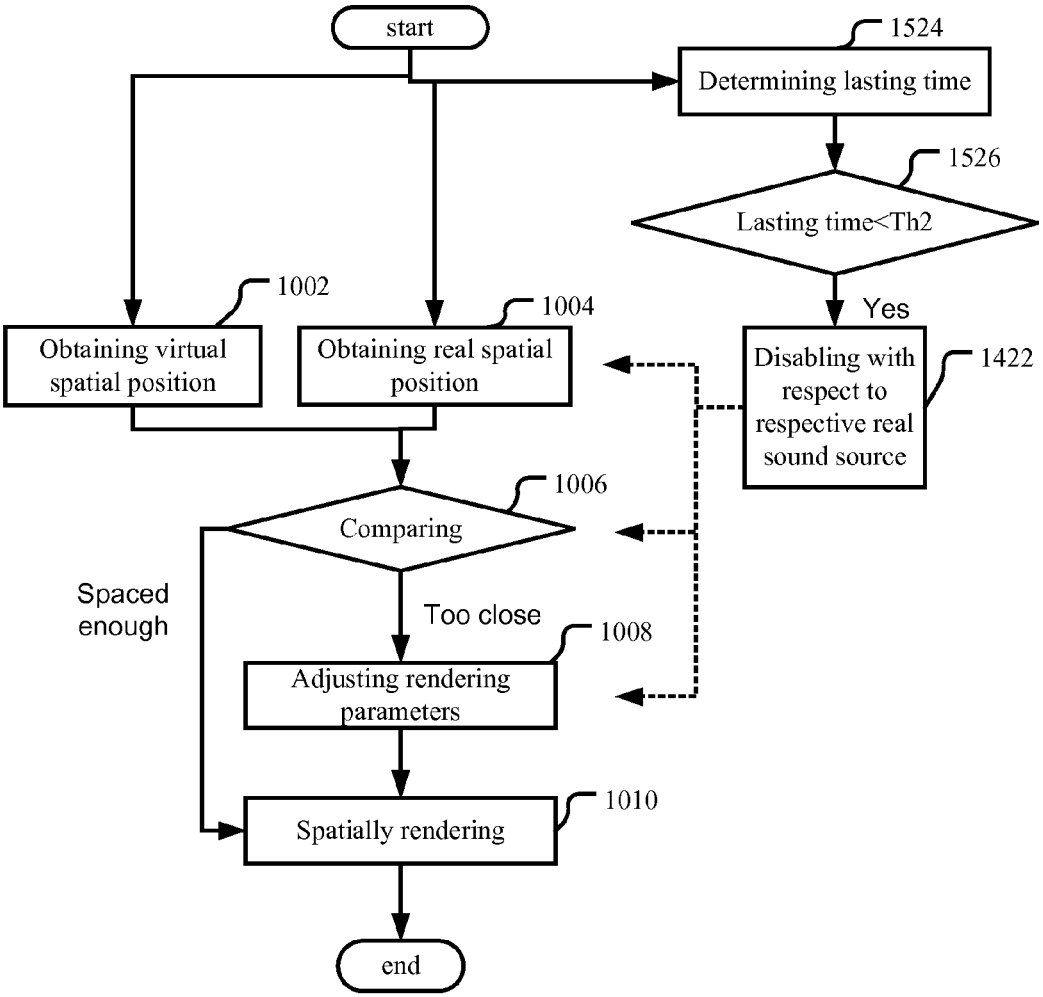

To be tolerant of occasional interruptions in the listening environment, a real sound source is regarded as moved only if the movement thereof lasts more than a predetermined time period, and a new real sound source is regarded active only if it lasts more than a predetermined time period. Therefore, as shown in FIG. 15, the audio spatial rendering method may further comprise an operation for determining a length of the lasting time of the real sound source (operation 1524), and the parameters will not be adjusted when the length of the lasting time is less than a predetermined threshold Th2 ("Yes" in operation 1526). Here, similar to FIG. 14, to make the parameters not adjusted, any of the operation of obtaining the real spatial position (operation 1004), the operation of comparing (operation 1006) and the operation of adjusting the rendering parameters (operation 1008) may be disabled. Note that here, "disablement" is just with respect to the real sound source the lasting time of which is less than the predetermined threshold Th2. For the other real sound sources, these operations still work normally.

Similar to the embodiments of the audio spatial rendering apparatus, any combination of the embodiments and their variations are practical on one hand; and on the other hand, every aspect of the embodiments and their variations may be separate solutions.

Please note the terminology used herein is for the purpose of describing particular embodiments only and is not intended to be limiting of the application. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, operations, steps, elements, and/or components, but do not preclude the presence or addition of one or more other features, integers, operations, steps, elements, components, and/or groups thereof.

The corresponding structures, materials, acts, and equivalents of all means or operation plus function elements in the claims below are intended to include any structure, material, or act for performing the function in combination with other claimed elements as specifically claimed. The description of the present application has been presented for purposes of illustration and description, but is not intended to be exhaustive or limited to the application in the form disclosed. Many modifications and variations will be apparent to those of ordinary skill in the art without departing from the scope and spirit of the application. The embodiment was chosen and described in order to best explain the principles of the application and the practical application, and to enable others of ordinary skill in the art to understand the application for various embodiments with various modifications as are suited to the particular use contemplated.

We claim:

1. An audio spatial rendering apparatus comprising:

a rendering unit for spatially rendering an audio stream so that the reproduced far-end sound is perceived by a listener as originating from at least one virtual spatial position;

a real position obtaining unit for obtaining a real spatial position of a real sound source;

a comparator for comparing the real spatial position with the at least one virtual spatial position; and an adjusting unit for, when the real spatial position is within a first predetermined range around at least one virtual spatial position, or vice versa, adjusting the parameters of the rendering unit so that the at least one virtual spatial position is changed, wherein the adjusting unit is configured not to adjust the parameters of the rendering unit when the real spatial position is inside a second predetermined range of a near-end microphone array.

2. The audio spatial rendering apparatus according to claim 1, wherein the adjusting unit is configured to adjust the parameters of the rendering unit so that the at least one virtual spatial position is rotated around the listener away from the virtual spatial position, and/or the at least one virtual spatial position is moved to a position closer to the listener.

3. The audio spatial rendering apparatus according to claim 1, wherein the real position obtaining unit, the comparator and the adjusting unit are configured to work in a calibration stage of the audio spatial rendering apparatus or in real time.

4. The audio spatial rendering apparatus according to claim 1, further comprising a sound activity detector for detecting the start and end of a far-end sound in the audio stream, wherein the real position obtaining unit and/or the adjusting unit is configured to work when there is no far-end sound.

5. The audio spatial rendering apparatus according to claim 4, wherein the sound activity detector comprises a voice activity detector, and the real position obtaining unit and/or the adjusting unit is configured to work when there is no far-end speech.

6. The audio spatial rendering apparatus according to claim 1, further comprising an energy estimator for estimating the energy of the real sound source, wherein the adjusting unit is configured not to adjust the parameters of the rendering unit when the estimated energy is higher than a predetermined threshold.

7. The audio spatial rendering apparatus according to claim 1, further comprising a timer for determining a length of time of the lasting of the real sound source, wherein the adjusting unit is configured not to adjust the parameters of the rendering unit when the length of time is less than a predetermined threshold.

8. The audio spatial rendering apparatus according to claim 1, wherein the rendering unit is configured to spatially render the audio stream based on a head-related transfer function and/or an inter-aural time difference and/or an inter-aural intensity difference.

9. The audio spatial rendering apparatus according to claim 8, wherein the rendering unit is further configured to spatially render the audio stream based on ratio of direct-to-reverberation energy.

10. The audio spatial rendering apparatus according to claim 1, wherein the real position obtaining unit comprises a microphone array and is configured to estimate the real spatial position of the real sound source based on sounds captured by the microphone array and using a direction-of-arrival algorithm.

11. The audio spatial rendering apparatus according to claim 10, wherein the real position obtaining unit is configured to estimate the real spatial position of the real sound source using a generalized cross correlation-phase transform (GCC-PHAT) algorithm.

12. The audio spatial rendering apparatus according to claim 1, wherein the real position obtaining unit comprises an input unit via which the real spatial position of the real sound source is input.

13. An audio spatial rendering method comprising:

obtaining at least one virtual spatial position from which a reproduced far-end sound to be spatially rendered from an audio stream is perceived by a listener as originating;

obtaining a real spatial position of a real sound source;

comparing the real spatial position with the at least one virtual spatial position;

adjusting, when the real spatial position is within a first predetermined range around at least one virtual spatial position, or vice versa, adjusting the parameters of the rendering unit so that the at least one virtual spatial position is changed, wherein the adjusting unit is configured not to adjust the parameters of the rendering unit when the real spatial position is inside a second predetermined range of a near-end microphone array; and spatially rendering the audio stream based on the parameters.

14. A non-transitory computer-readable medium having computer program instructions recorded thereon, when being executed by a processor, the instructions enabling the processor to execute an audio spatial rendering method comprising:

obtaining at least one virtual spatial position from which a reproduced far-end sound to be spatially rendered from an audio stream is perceived by a listener as originating;

obtaining a real spatial position of a real sound source;

comparing the real spatial position with the at least one virtual spatial position;

adjusting, when the real spatial position is within a first predetermined range around at least one virtual spatial position, or vice versa, adjusting the parameters of the rendering unit so that the at least one virtual spatial position is changed, wherein the adjusting unit is configured not to adjust the parameters of the rendering unit when the real spatial position is inside a second predetermined range of a near-end microphone array; and spatially rendering the audio stream based on the parameters.

* * * * *